US009327529B2

(12) United States Patent
Kato et al.

(10) Patent No.: US 9,327,529 B2
(45) Date of Patent: May 3, 2016

(54) RECORDING APPARATUS

(71) Applicant: SEIKO EPSON CORPORATION, Tokyo (JP)

(72) Inventors: Junya Kato, Matsumoto (JP); Seijun Horie, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/667,140

(22) Filed: Mar. 24, 2015

(65) Prior Publication Data

US 2015/0273897 A1 Oct. 1, 2015

(30) Foreign Application Priority Data

Mar. 28, 2014 (JP) ..... 2014-068247

(51) Int. Cl.

*B41J 13/00* (2006.01)
*B41J 13/10* (2006.01)
*B65H 29/26* (2006.01)

(52) U.S. Cl.

CPC ..... *B41J 13/0009* (2013.01); *B41J 13/106* (2013.01); *B65H 29/26* (2013.01)

(58) Field of Classification Search

CPC .... B41J 13/0045; B41J 13/0009; B41J 15/00; B41J 15/005; B41J 11/00; B41F 13/02
See application file for complete search history.

(56) References Cited

U.S. PATENT DOCUMENTS 6,568,865 B1 * 5/2003 Fujioka ..... B65H 31/00 271/207
7,121,543 B2 * 10/2006 Fujioka ..... B41J 11/0005 271/207
2010/0111584 A1 5/2010 Shiohara et al.
2014/0292980 A1 * 10/2014 Horie ..... B41J 11/001 347/104

FOREIGN PATENT DOCUMENTS

EP 1 095 889 5/2001
EP 2 532 497 12/2012
JP 2002-205862 7/2002
JP 2013-082516 5/2013

OTHER PUBLICATIONS

European Search Report for Application No. 15161301.5 dated Dec. 23, 2015.

* cited by examiner

*Primary Examiner* — Justin Seo
*Assistant Examiner* — Michael Konczal
(74) *Attorney, Agent, or Firm* — Workman Nydegger

(57) ABSTRACT

A recording apparatus includes a recording unit, a discharge unit, and a medium receiving unit. The medium receiving unit has a sheet section which is flexible and of which a front-end portion is disposed to be closer to a discharge side of a recording medium than a terminal-end portion. When the medium receiving unit is transited from a serviceable state to an accommodated state, the front-end portion of the sheet section becomes closer to the terminal-end portion of the sheet section and a connection portion between the front-end portion and the terminal-end portion of the sheet section moves to a side opposite to the discharge side.

8 Claims, 12 Drawing Sheets

COMPARATIVE EXAMPLE

RECORDING APPARATUS

The entire disclosure of Japanese Patent Application No: 2014-068247, filed Mar. 28, 2014 is expressly incorporated by reference herein in its entirety.

BACKGROUND

1. Technical Field

The present invention relates to a recording apparatus.

2. Related Art

An ink jet printer includes a large-sized printer which performs printing on a relatively large-sized recording medium, that is, a paper roll having a width of A0 or A1 regulated by Japanese Industrial Standards (JIS). A recording apparatus such as the ink jet printer includes an apparatus in which printing is performed on recording paper unwound from a paper roll, the recording paper is cut and is discharged from a discharge slot, and a sheet of the recording paper drops downward from the discharge slot. As a structure on which printed matters are stacked, for example, a basket is used in which a flexible sheet member goes slack and is attached to a frame member.

In addition, JP-A-2002-205862 discloses an ink jet printer that includes a flexible sheet member and multiple latching members which can latch end portions of the sheet member. The sheet member is formed to be rectangular and both end portions and an intermediate portion thereof are caught along multiple shafts, respectively. The latching members can latch ends of the shafts, respectively, such that axes of the shafts are parallel to each other.

In a case where a basket (in which a sheet member goes slack and is attached to a frame member) is accommodated, there is a need to accommodate a remaining portion of the sheet member by hand because the remaining portion of the sheet member is not accommodated after accommodating the frame member.

This phenomenon is not limited to the ink jet printer, but, similarly, occurs in various recording apparatuses.

SUMMARY

An advantage of some aspects of the invention is to provide a recording apparatus in which it is possible to easily accommodate a flexible sheet member.

According to an aspect of the invention, a recording apparatus includes: a recording unit that performs recording on a recording medium; a discharge unit that discharges the recording medium on which recording is finished; and a medium receiving unit that receives the discharged recording medium. The medium receiving unit includes a sheet section which is flexible and of which a front-end portion is disposed to be closer to a discharge side of the recording medium than a terminal-end portion, a front-end holding section that has a base portion which is slidable in a sliding direction passing through an accommodation position and a serviceable position, extends from the base portion to a discharge side, and holds the front-end portion of the sheet section, and a linkage section that links a connection portion between the front-end portion and the terminal-end portion to the base portion in the sheet section. When the base portion of the front-end holding section slides to a side of the accommodation position from the serviceable position, the front-end portion of the sheet section becomes closer to the terminal-end portion of the sheet section and the connection portion of the sheet section moves to a side opposite to the discharge side.

That is, when the base portion of the front-end holding section in the medium receiving unit slides to the side of the accommodation position from the serviceable position, the front-end portion of the sheet section which is held by the front-end holding section becomes closer to the terminal-end portion of the sheet section. In addition, the connection portion of the sheet section linked to the base portion by the linkage section moves to a side opposite to the discharge side of the recording medium. Accordingly, a remaining portion of the sheet section is prevented from sticking out from the accommodation position. Thus, in the present aspect, it is possible to provide a recording apparatus in which it is possible to easily accommodate the flexible sheet section.

Further, the invention may be applied to a multifunction apparatus that includes a recording apparatus, a recording method that includes processes corresponding to the units described above, a processing method for the multifunction apparatus which includes the recording method, a recording program that causes a computer to execute functions corresponding to the units described above, a processing program for the multifunction apparatus which includes the recording program, a computer readable medium in which these programs are stored, or the like. The apparatus described above may be configured to include multiple scattered components.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
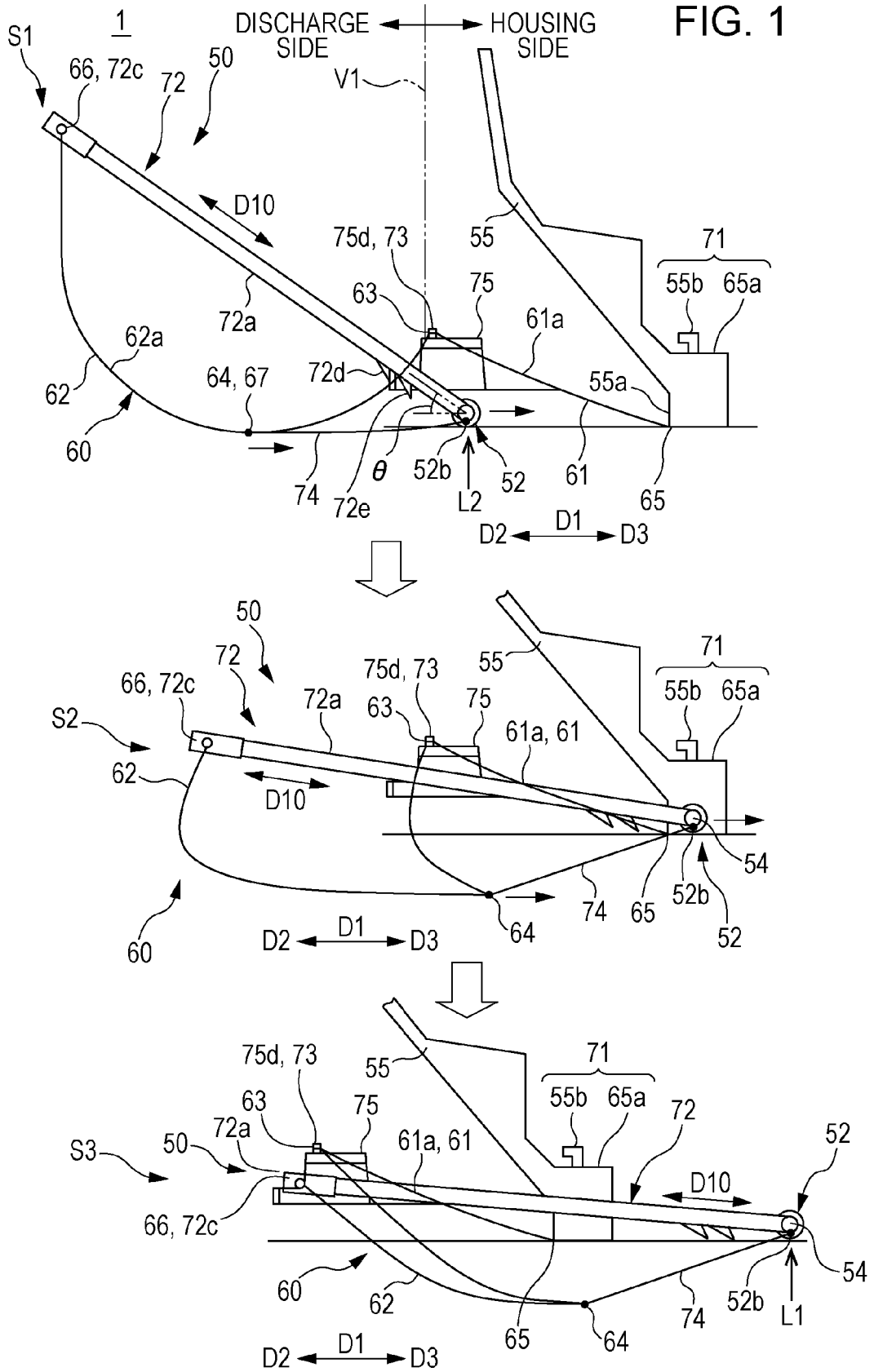
FIG. 1 is a view schematically illustrating a state in which a stacker (medium receiving unit) is accommodated.

Hereinafter, embodiments of the invention will be described. Needless to say, the following embodiments are only provided to illustrate the invention; thus, the entire characteristics of the provided embodiments are not necessary for the invention.

(1) Outline of Disclosure

First, the outline of the disclosure is described with reference to FIGS. 1 to 11.

A recording apparatus 1 according to the disclosure illustrated in FIGS. 1 to 11 includes a recording unit 12 that performs recording on a recording medium R3, a discharge unit 17 that discharges the recording medium R3 on which recording is finished (hereinafter, described as recording-finished medium R4) and a medium receiving unit (stacker 50) that receives the discharged recording-finished medium R4. The medium receiving unit (50) includes 1) a sheet section (sheet member 60) which is flexible and of which a front-end portion 66 is disposed to be closer to a discharge side of the recording-finished medium R4 than a terminal-end portion 65, 2) a front-end holding section 72 that has a base portion 52 which is slidable in a sliding direction D1 passing through an accommodation position L1 and a serviceable position L2, extends from the base portion 52 to a discharge side, and holds the front-end portion 66 of the sheet section (60), and 3) a linkage section (strap 74) that links a connection portion 64 between the front-end portion 66 and the terminal-end portion 65 to the base portion 52 in the sheet section (60). Here, the discharge side means a front side in a direction in which the recording medium is discharged from the discharge unit. When the base portion 52 of the front-end holding section 72 slides to the side of the accommodation position L1 from the serviceable position L2, the front-end portion 66 of the sheet section (60) becomes closer to the terminal-end portion 65 of the sheet section (60) and the connection portion 64 of the sheet section (60) moves to a side (housing 10 side) opposite to the discharge side.

Figure 12:
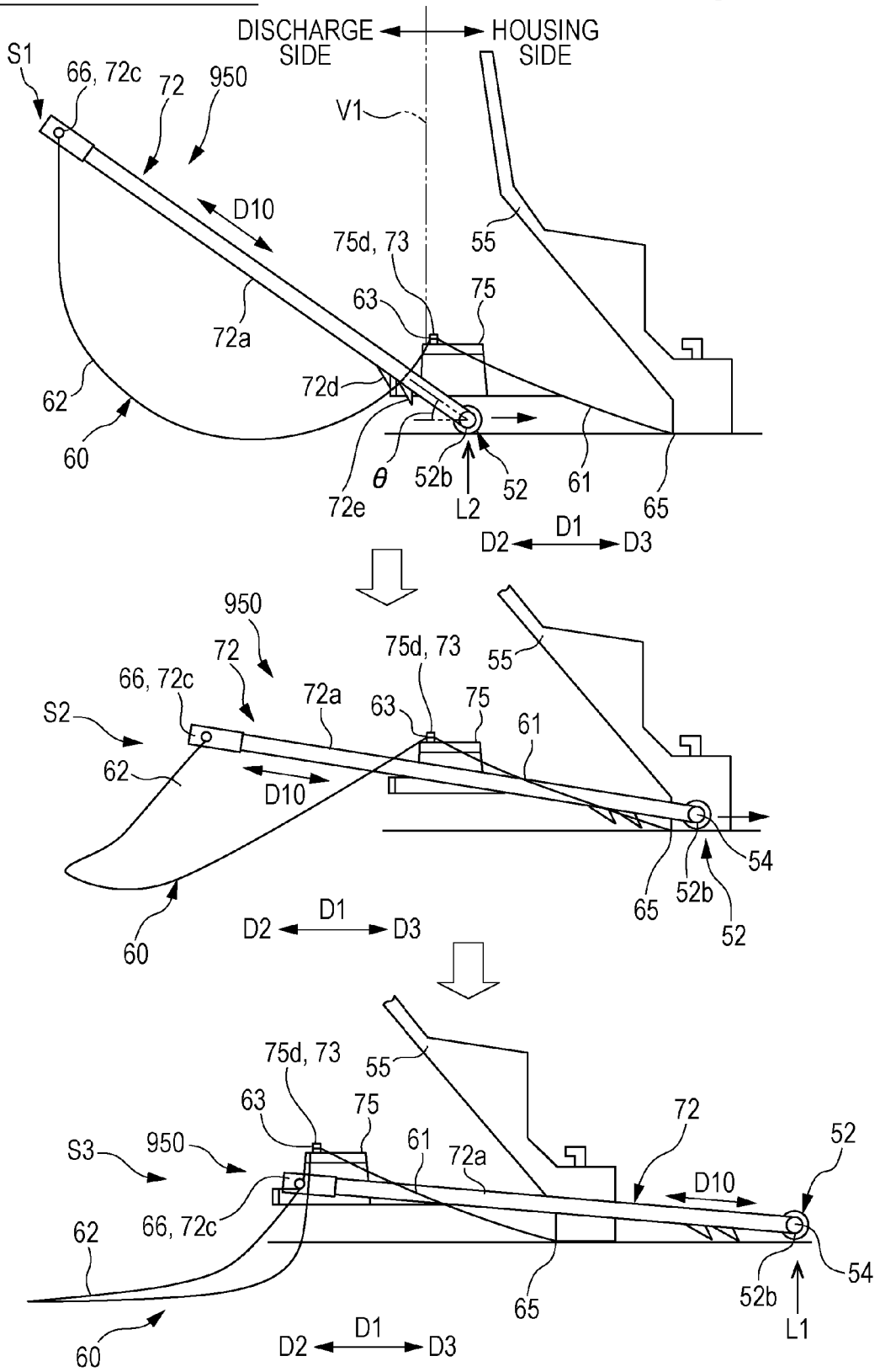
FIG. 12 is a view schematically illustrating a state in which a stacker according to a comparative example is accommodated.

Here, the disclosure is compared to a stacker 950 illustrated in FIG. 12. A comparative example illustrated in FIG. 12 is not an example representing a real example in the related art but an imaginary example in which the linkage section (74) provided in the example illustrated in FIGS. 1 to 9D is not provided.

In a serviceable state S1 illustrated in FIG. 12, when a latching portion 72*d* (or latching portion 72*e*) is unlatched from a tilting mechanism 75 and the frame-like front-end holding section 72 is pressed to the housing 10, the base portion 52 slides to the side of the accommodation position L1 from the serviceable position L2. As shown in an intermediate state S2 and an accommodated state S3, even when the frame-like front-end holding section 72 is accommodated, a remaining portion (curved portion 62) of the sheet member 60 is not accommodated. Therefore, according to the comparative example, there is a need to accommodate the remaining portion of the sheet member 60 by hand. When a shaft around which the sheet member is wound and a rack that supports the shaft are provided as measures against the problem, a structure of the stacker becomes complicated and work of winding the sheet member during accommodation is a time-consuming process.

Meanwhile, according to the disclosure, as illustrated in FIG. 1, when the base portion 52 of the front-end holding section 72 of the medium receiving unit (50) slides to the side of the accommodation position L1 from the serviceable position L2, the front-end portion 66 of the sheet section (60) which is held in the front-end holding section 72 becomes closer to the terminal-end portion 65 of the sheet section (60). In addition, the connection portion 64 in the sheet section (60) linked to the base portion 52 by the linkage section (74) is coupled to the front-end holding section 72 and moves together to the side (housing 10 side) opposite to the discharge side of the recording-finished medium R4, and then the sheet section (60) is accommodated. Accordingly, the remaining portion (curved portion 62) of the sheet section (60) is prevented from sticking out from the accommodation position. Thus, according to the disclosure, it is possible to save time and efforts for accommodating the flexible sheet section (60) and to easily accommodate the sheet section (60).

Here, examples of the recording apparatus 1 include an ink jet printer, a wire dot printer, a laser printer, a line printer, a multifunction machine, a facsimile, or the like.

The recording-finished medium R4 includes the recording medium R3 on which recording is not performed but passes the recording unit 12.

Incidentally, the medium receiving unit (50) includes a terminal-end holding section 71 that holds the terminal-end portion 65 of the sheet section (60). In addition, the medium receiving unit (50) may include a second connection-portion holding section 73 that holds a second connection portion 63 between the connection portion 64 and the terminal-end portion 65 in the sheet section (60). Further, when the base portion 52 of the front-end holding section 72 slides to the side of the accommodation position L1 in the direction from the serviceable position L2, a positional relationship between the second connection-portion holding section 73 and the terminal-end holding section 71 may be maintained. In the aspect, the positional relationship between the second connection-portion holding section 73 and the terminal-end holding section 71 is maintained and the connection portion 64 of the sheet section (60) on the discharge side from the second connection portion 63 moves to a side opposite to the discharge side. Thus, in the aspect, it is possible to appropriately accommodate the flexible sheet section (60).

Figure 3:
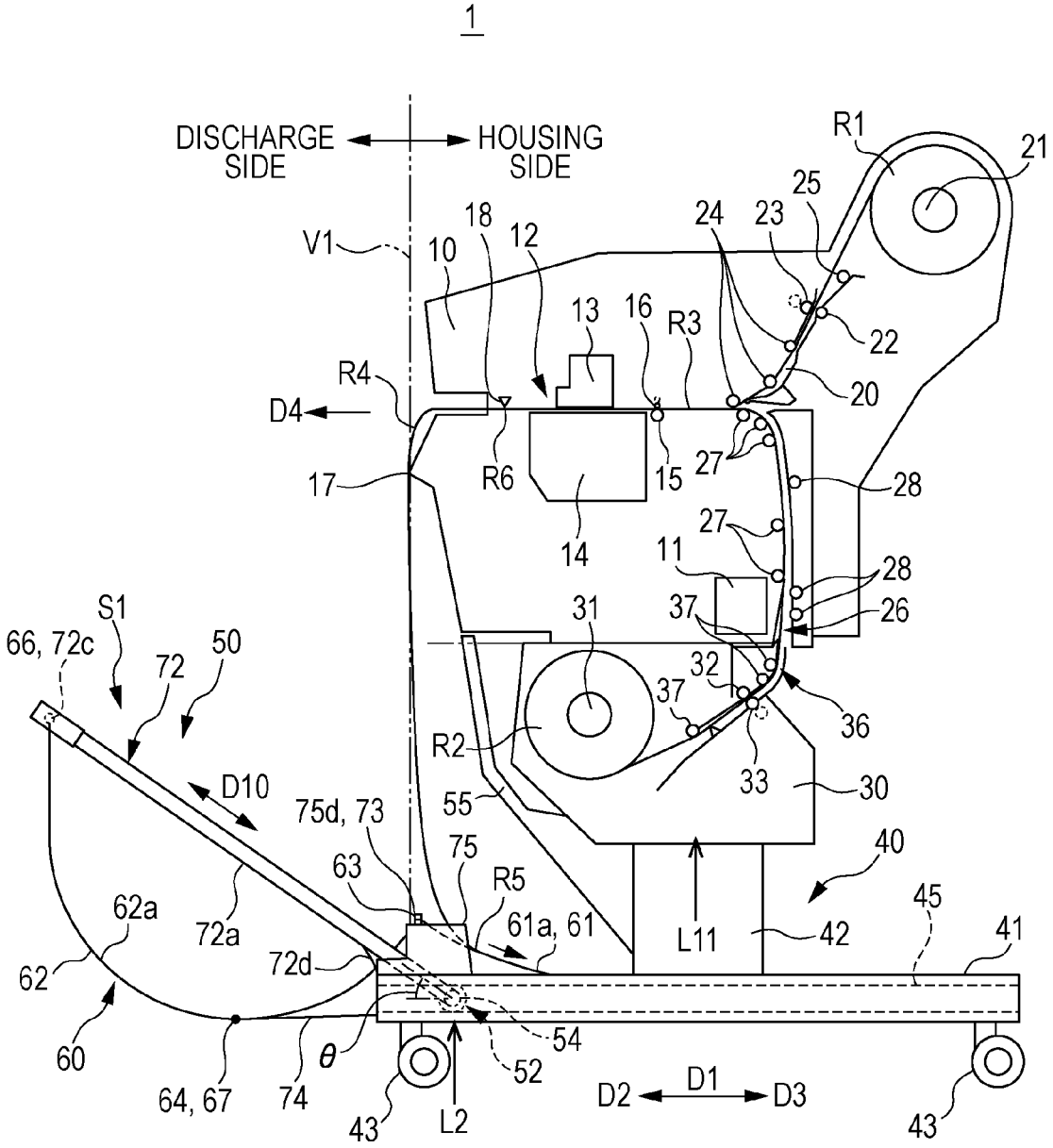
FIG. 3 is a vertical cross-sectional view illustrating the inside of the recording apparatus.

When the positions of the second connection portion 63 and the discharge unit 17 are compared to each other, the comparison is performed, as a reference, with the outermost portion of the discharge unit 17 in a discharge direction D4 as illustrated in FIG. 3.

The sheet section (60) may have a slope 61*a* with which a leading edge R5 of the recording-finished medium R4 which is discharged and drops from the discharge unit 17 comes into contact between the second connection portion 63 and the terminal-end portion 65. The slope 61*a* may descend from the second connection portion 63 to the terminal-end portion 65. In the aspect, the leading edge R5 of the recording-finished medium R4 that is discharged and drops from the discharge unit 17 comes into contact with the slope 61*a* and is guided to a side of the terminal-end portion 65 which is lower than the second connection portion 63. Then, since the recording-finished medium R4 is stacked in the sheet section (60), a following edge R6 that sticks out from the sheet section (60) is unlikely to come into contact with a bed even in a case of the lengthy recording-finished medium R4. Thus, in the aspect, it is possible to more appropriately stack the recording-finished medium R4.

The medium receiving unit (50) may include the tilting mechanism 75 in which an angle θ between an extending direction D10 and the sliding direction D1 of the front-end holding section 72 is changed. In addition, the angle θ formed when the base portion 52 of the front-end holding section 72 is disposed at the accommodation position L1 may be smaller than the angle θ formed when the base portion 52 of the front-end holding section 72 is disposed at the serviceable position L2. In the aspect, since the medium receiving unit (50) is accommodated so as to become approximately parallel to the sliding direction D1 of the base portion 52, it is possible to appropriately accommodate the medium receiving unit (50) that has the flexible sheet section (60).

The recording apparatus 1 may include a rail 45 in the sliding direction D1. The base portion 52 of the front-end holding section 72 may be mounted so as to be slidable along the rail 45. In the tilting mechanism 75, as the front-end portion 66 of the sheet section (60) becomes closer to the terminal-end portion 65 of the sheet section (60), the angle θ becomes smaller with the base portion 52 as the center. In this aspect, since, as the front-end portion 66 of the sheet section (60) becomes closer to the terminal-end portion 65 of the sheet section (60), the extending direction D10 of the front-end holding section 72 becomes approximately parallel to the sliding direction D1 of the base portion 52, it is possible to appropriately accommodate the medium receiving unit (50) that has the flexible sheet section (60).

The recording apparatus 1 may include a housing 10 in which the discharge unit 17 is provided and a leg 40 that supports the housing 10. The base portion 52 of the front-end holding section 72 may be provided so as to be slidable with respect to the leg 40. In the aspect, since the medium receiving unit (50) is accommodated in response to the sliding movement of the base portion 52 of the front-end holding section 72 with respect to the leg 40, it is possible to accommodate the medium receiving unit (50) in the vicinity of the leg 40.

(2) Specific Example o Recording Apparatus

Figure 2:
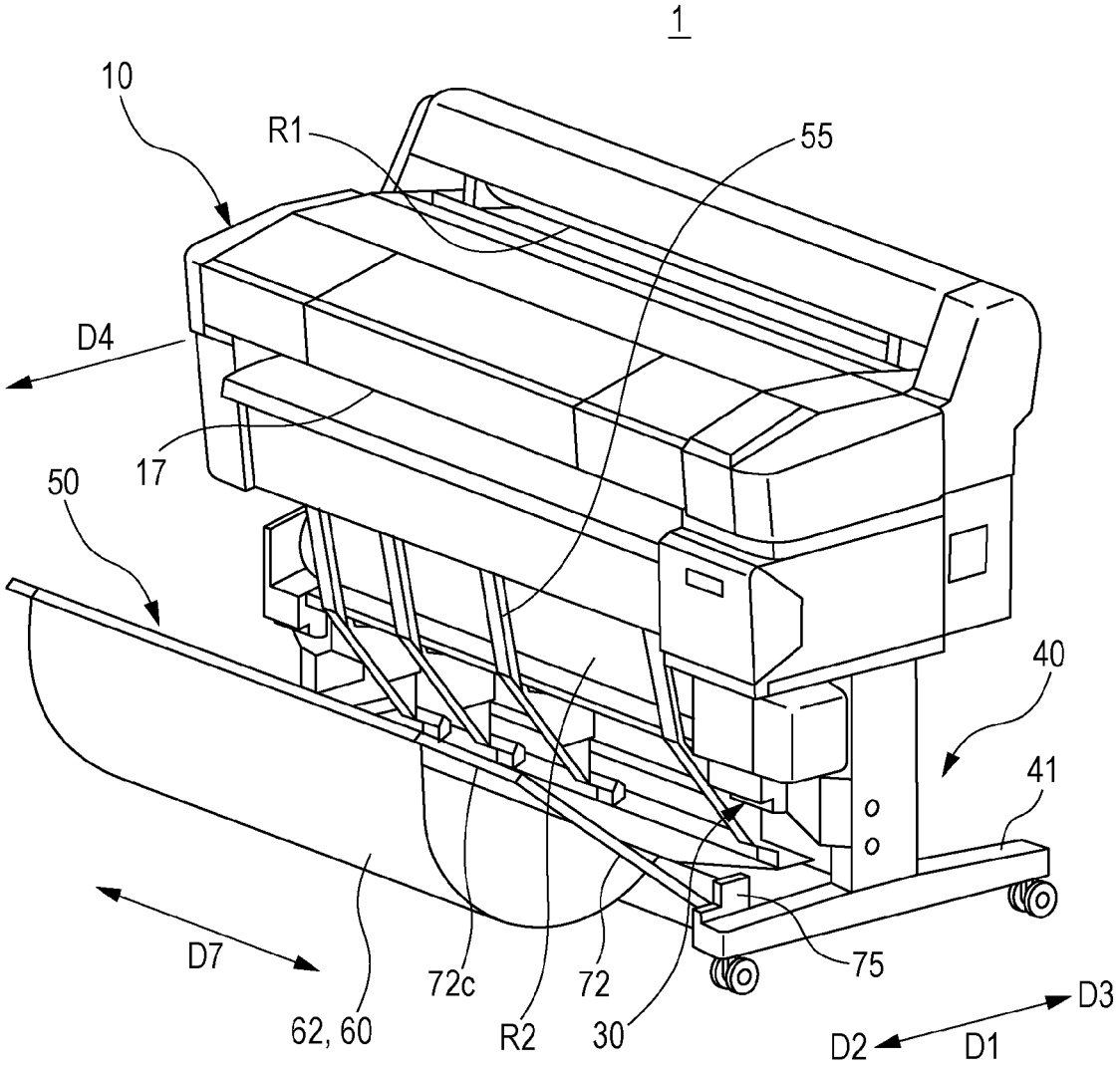
FIG. 2 is a perspective view illustrating an external appearance of a recording apparatus.
Figure 4:
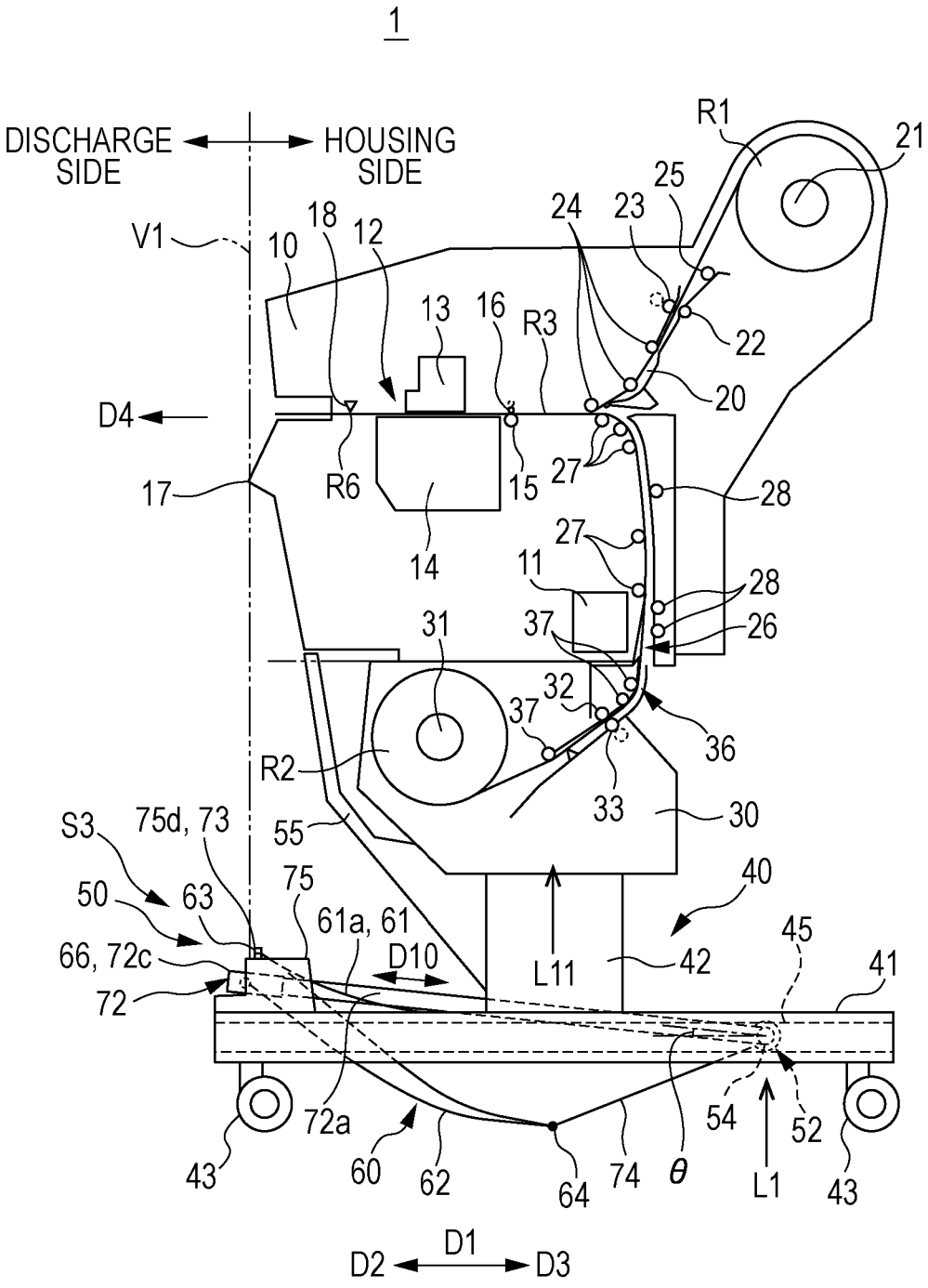
FIG. 4 is a vertical cross-sectional view illustrating the recording apparatus in a state in which a stacker is accommodated.
Figure 5:
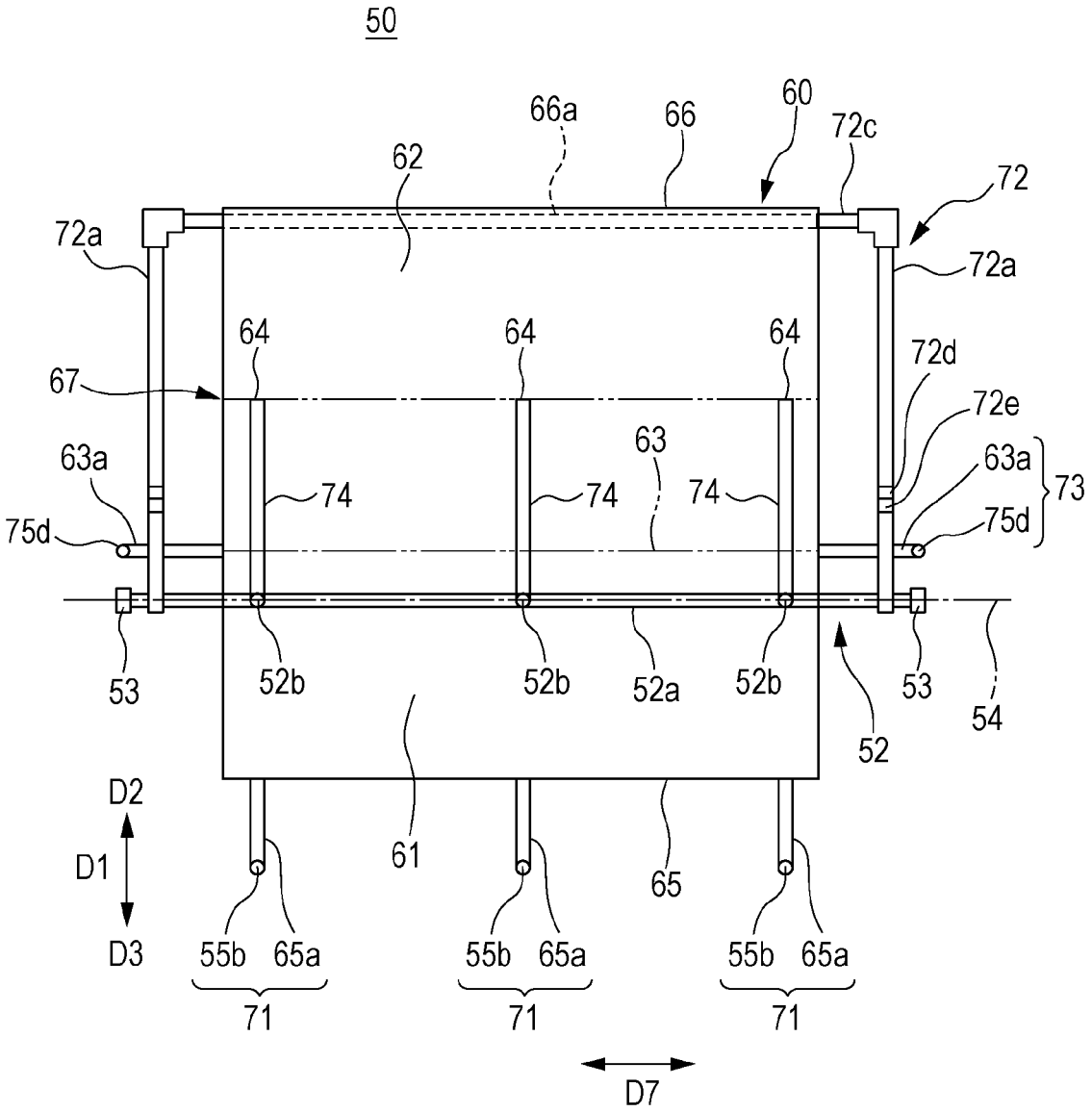
FIG. 5 is a bottom view illustrating the stacker.
Figure 6:
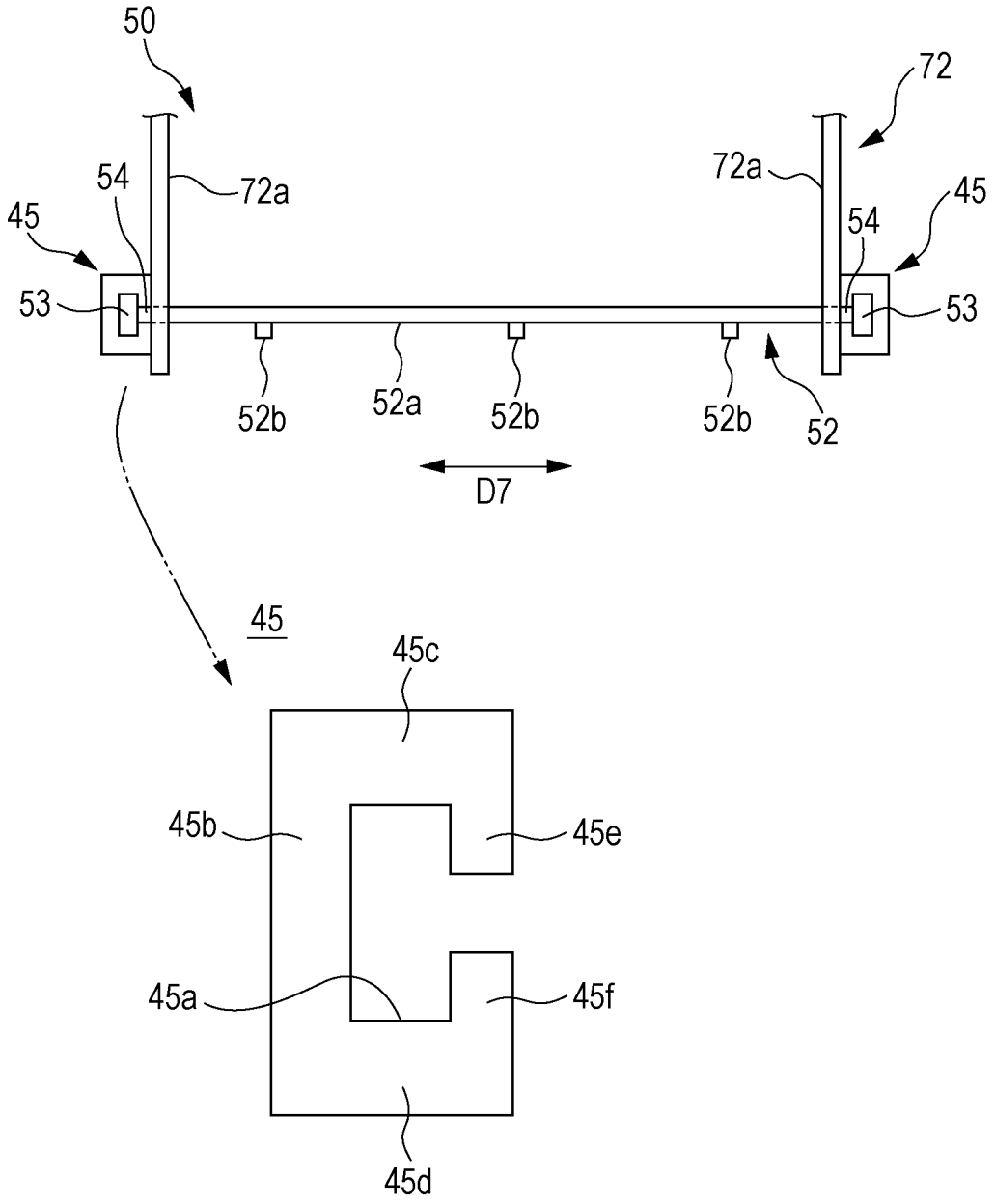
FIG. 6 is a front view illustrating main components of a rail and the stacker.
Figure 7:
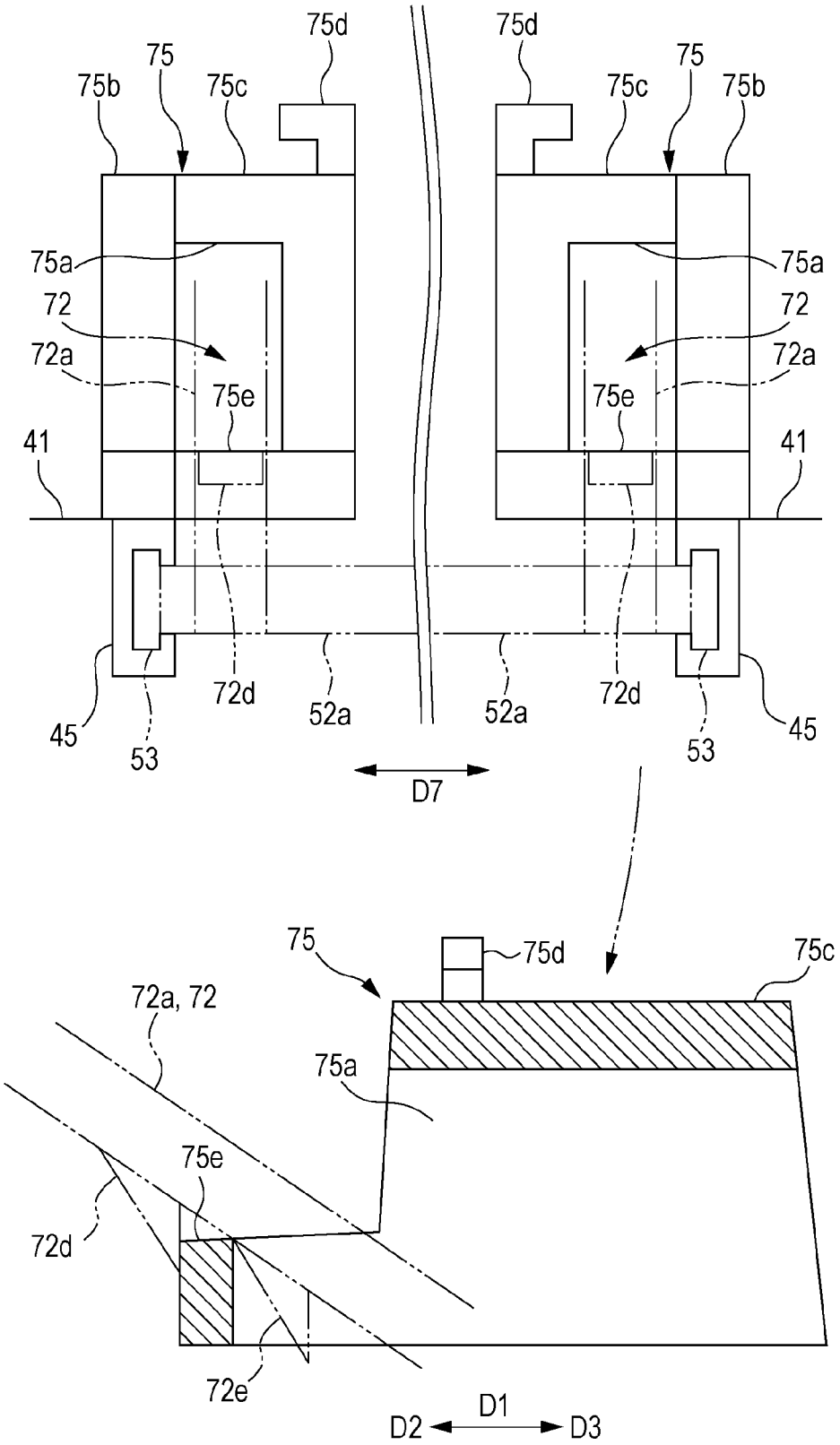
FIG. 7 is a front view illustrating a tilting mechanism.
Figure 8:
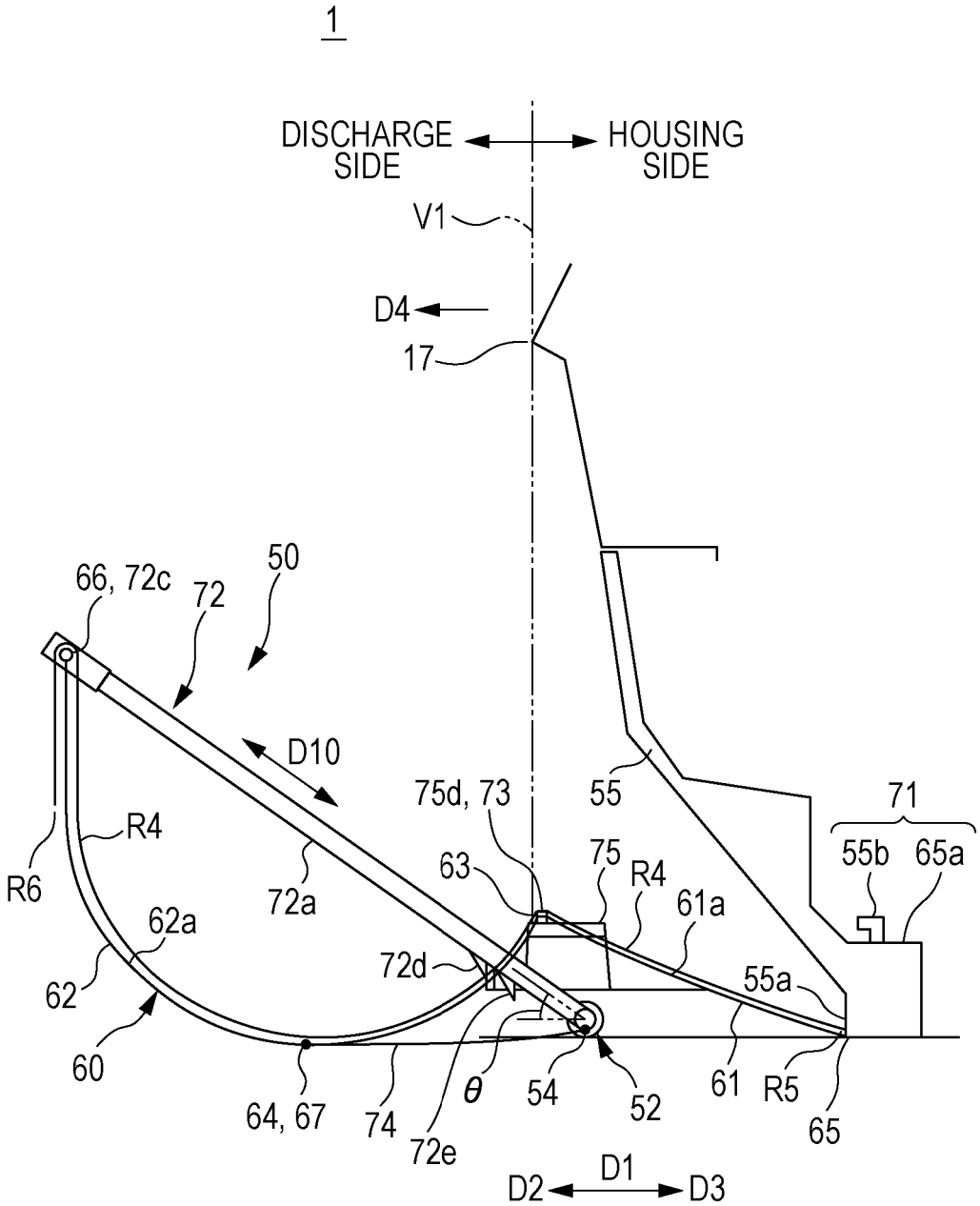
FIG. 8 is a view schematically illustrating a state in which a recording medium on which recording is finished is accommodated in the stacker.
Figure 9A:
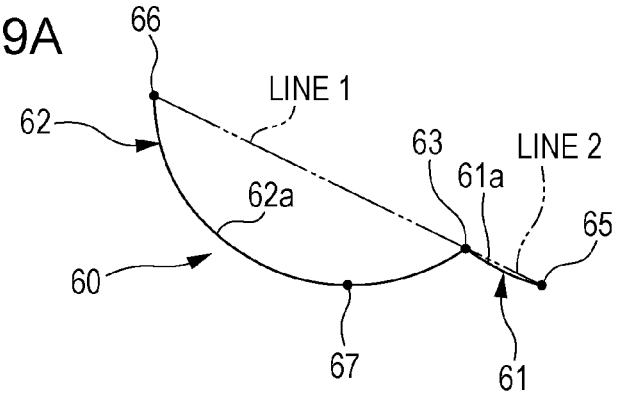
FIGS. 9A to 9D are side views schematically illustrating a curved state and a bent state of a sheet member (sheet section).
Figure 9B:
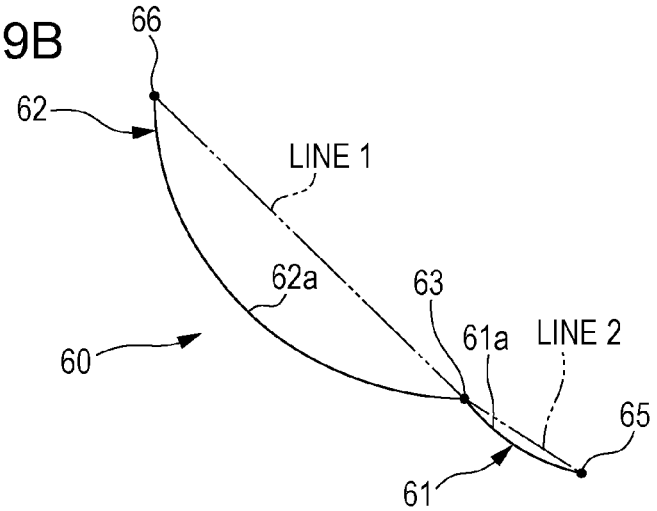
Figure 9C:
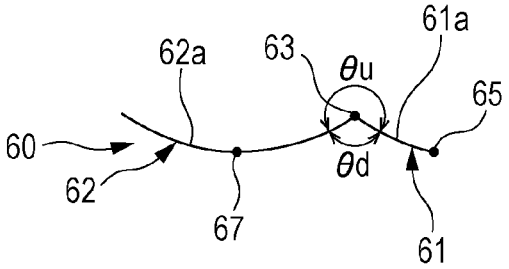
Figure 9D:
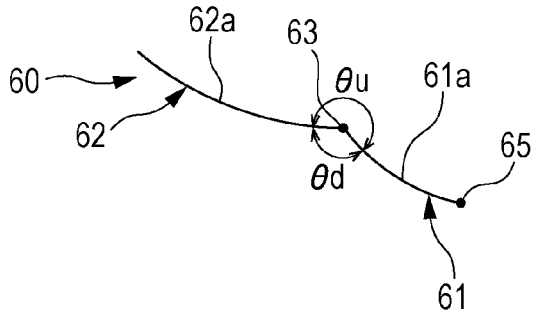

FIG. 1 is a view schematically illustrating a state in which a stacker (medium receiving unit) 50 is accommodated and a perpendicular surface V1 passing through the discharge unit 17 is shown by a two-dot chain line. FIG. 2 is a perspective view illustrating an external appearance of a large-sized ink jet printer as an example of the recording apparatus 1. FIG. 3 is a vertical cross-sectional view illustrating the inside of the recording apparatus 1 when viewing the housing 10 in a cross-sectional view. FIG. 4 is a vertical cross-sectional view illustrating the recording apparatus 1 in a state in which the stacker 50 is accommodated at the accommodation position L1. FIG. 5 is a view illustrating the bottom side of the stacker 50. FIG. 6 is a front view illustrating main components of the rail 45 and the stacker 50 and illustrates the enlarged rail 45 on the lower side. FIG. 7 is a front view illustrating the tilting mechanism 75 and, on the lower side, is a vertical cross-sectional view illustrating the tilting mechanism 75 when viewed from the side thereof. FIG. 8 is a view schematically illustrating a state in which the recording-finished medium R4 is accommodated in the stacker 50.

Reference sign D1 in the drawings represents a sliding direction of the base portion 52 with respect to the leg 40. The base portion 52 is included in the front-end holding section 72 of the stacker 50. Reference sign D2 represents a separating direction on one side of the sliding direction. The separating direction D2 is the separating direction of the base portion 52 with respect to the terminal-end portion 65 of the sheet member 60. Reference sign D3 represents an approaching direction on the other side in the sliding direction. Reference sign D4 represents a discharge direction of the recording-finished medium R4 from the discharge unit 17. The discharge direction D4 in the drawings is parallel to the sliding direction D1, but may not be parallel to the sliding direction D1. Reference sign D7 represents a width direction of the recording apparatus which is orthogonal to the discharge direction D4 and the perpendicular direction. FIGS. 1, 3, 4, and 8 are views when viewed from the outside of the recording apparatus 1 in the width direction D7. Reference sign D10 represents an extending direction of the front-end holding section 72.

For easy understanding, scaling in directions are different from each other and some drawings are not matched.

In addition, a positional relationship described in the specification is only provided as an example in order to describe the invention and thus, the invention is not limited thereto. Thus, the invention includes an example in which a feeding unit 30 is disposed at a position other than a position under the housing 10, for example, over, the left of, or the right of the housing 10.

Further, the same or orthogonal to a direction, position, or the like, does not mean exactly the same or orthogonal to a direction, position, or the like, but an error or the like occurring at the time of manufacturing or the like is also included in the meaning.

The recording apparatus 1 described above illustrated in FIG. 1 is the large-sized ink jet printer which can perform recording on a relatively large-sized recording medium including a size of A0, A1, or the like regulated by JIS. The recording apparatus 1 includes the housing 10 in which the discharge unit 17 is provided, the leg 40 that supports the housing 10, and the stacker 50 that receives the recording-finished medium R4 which is discharged and drops down from the discharge unit 17 of the housing 10. The stacker 50 includes the sheet member 60, the frame-like front-end holding section 72 that holds the front-end portion 66 of the sheet member 60, the tilting mechanism 75, and the like. Particularly, the stacker 50 according to the disclosure includes the linkage section (strap 74) that links the connection portion 64 between the front-end portion 66 and the terminal-end portion 65 in the sheet section to the base portion 52. The sheet section in this example means a main body portion of the sheet member 60 and does not include straps 63*a*, 65*a*, and 74 in sheet shapes which are attached thereto. The base portion 52 of the front-end holding section 72 can slide in the sliding direction D1 passing through the accommodation position L1 and the serviceable position L2. When the base portion 52 is placed at the serviceable position L2, a curved surface 62*a* (which is curved so as to form a downward convex shape in the curved portion 62 on the discharge side from the second connection portion 63 when viewed from the side) is formed in the sheet member 60 and the slope 61*a* (with which the leading edge R5 of the recording-finished medium R4 comes into contact) is formed in a slope portion 61 on a side (housing 10 side) opposite to the discharge side from the second connection portion 63. The second connection portion 63 is formed on the housing 10 side from the connection portion 64.

In the recording apparatus 1 illustrated in the drawings described above, the feeding unit 30 is slidably provided under the housing 10 and it is possible to perform printing (recording) switching between a first paper roll R1 deep on the upper side of the apparatus and a second paper roll R2 on the lower side of the apparatus. The paper roll is continuous paper which is the recording medium wound in a rolled shape. Both the paper rolls R1 and R2 have a printing surface on the outer side. When positions of unwinding mechanisms (medium supporting units) 21 and 31 are changed, it is possible to use a paper roll having a printing surface on the inner side. It is possible to use winding recording media having various materials such as paper, cloth, a plastic recording medium, leather, and the like as the paper roll. The paper rolls R1 and R2 are collectively referred to as the recording medium R3.

In addition, although not illustrated, the recording apparatus 1 inserts a sheet of cut paper from a manual feeding slot and performs printing thereon and it is possible to discharge the printed cut paper as the short recording-finished medium R4 form the discharge unit 17 and to stack the printed cut paper in the stacker 50.

As illustrated in FIG. 3, the housing 10 having the feeding unit 30 includes a control unit 11, the recording unit 12, a transport roller pair (15 and 16), the discharge unit 17, a cutter 18, a medium path 20 and feeding mechanisms (21 to 25) for the first paper roll, a first medium path 26 and a second medium path 36 and feeding mechanisms (27, 28, 31 to 33, and 37) for the second paper roll, or the like. The feeding unit 30 can slide between an accommodation position L11 on the approaching direction D3 side and a drawing-out position on the separating direction D2 side and is electrically connected to the control unit 11.

The control unit 11 includes a central processing unit (CPU), a ready only memory (ROM), a random access memory (RAM), or the like, and controls operations of the units in the recording apparatus 1, such as receiving an instruction of a recording output from an external host apparatus and printing on the recording medium. The recording medium R3 of the printing target is a portion drawn out from one of the paper rolls R1 and R2.

The recording unit 12 has a recording head 13 and a platen 14. The recording head 13 is disposed on the upper side facing the platen 14, and can discharge ink onto the recording medium R3 such that recording is performed. The platen 14 supports the recording medium R3 and a predetermined distance is formed between the recording medium R3 and the recording head 13.

The transport roller pair (15 and 16) includes a drive roller 15 disposed on the lower side and a driven roller 16 disposed on the upper side. The driven roller 16 can be separated from the drive roller 15 and nips the recording medium R3 with the drive roller 15 at the time of approaching each other.

The recording-finished medium R4 sent out from the discharge unit 17 is stacked in the stacker 50 when the recording-finished medium R4 is cut by the cutter 18 and the nipping by the transport roller pair (15 and 16) is released.

The feeding mechanism for the first paper roll includes the unwinding mechanism (medium supporting unit) 21 that supports the first paper roll R1, the feeding roller pair (22 and 23), and rollers (driven roller) 24 and 25. The paper roll R1 is mounted around the unwinding mechanism 21 in a direction in which the recording-finished medium R4 which is discharged from the discharge unit 17 and drops downward is bent to the housing 10 side. The feeding roller pair (22 and 23) includes a drive roller 22 disposed on the outer circumferential side of the medium path 20 and a driven roller 23 disposed on the inner circumferential side of the medium path 20. The driven roller 23 can be separated from the drive roller 22 and nips the paper roll R1 with the drive roller 22 at the time of approaching each other. At the time of feeding, the feeding roller pair (22 and 23) nips the paper roll R1 unwound from the unwinding mechanism 21 and transports the paper roll R1 to a side of the transport roller pair (15 and 16). During the printing (during recording), the transport roller pair (15 and 16) transports the recording medium onto the platen 14 and the recording head 13 discharges ink and performs recording on the recording medium.

The feeding mechanism for the second paper roll includes the unwinding mechanism (medium supporting unit) 31 that supports the second paper roll R2, a feeding roller pair (32 and 33), and rollers (driven rollers) 27, 28, and 37. The feeding roller pair (32 and 33) includes a drive roller 32 disposed on the inner circumferential side of the second medium path 36 and a driven roller 33 disposed on the outer circumferential side of the second medium path 36. The driven roller 33 can be separated from the drive roller 32 and nips a paper roll R2 with the drive roller 32 at the time of approaching each other. At the time of feeding, the feeding roller pair (32 and 33) on the second medium path 36 nips the paper roll R2 unwound from the unwinding mechanism 31 and transports the paper roll R2 to a side of the transport roller pair (15 and 16) through the first medium path 26. During the printing, the transport roller pair (15 and 16) transports the recording medium onto the platen 14 and the recording head 13 discharges ink and performs recording on the recording medium.

The leg 40 has a lengthy section 41, an extending section 42, and casters 43 and 43 at each of the opposite end portions of the recording apparatus 1 in the width direction D7 and supports the housing 10. As illustrated in FIG. 3, the longitudinal direction of the lengthy sections 41 is parallel to the sliding direction of the base portion 52. The extending section 42 extends upwards substantially from the center position of the lengthy section 41 to the housing 10. The casters 43 and 43 are attached on both end portions of each of the lengthy sections 41 in the sliding direction D1.

The rail 45 (in parallel with the sliding direction D1 of the stacker 50) is provided on the inner side surface of the lengthy section 41 in the width direction D7. As illustrated in FIG. 6, each of the rails 45 has a base portion 45*b* that is in contact with the lengthy section 41, extending portions 45*c* and 45*d* which extend to the inner side in the width direction D7 from the upper and lower edges of the base portion 45*b*, and right-angled portions 45*e* and 45*f* which extend in a direction in which the right-angled portions are approaching each other from the edge of the extending portions 45*c* and 45*d*. A portion surrounded by the portions 45*b* to 45*f* is formed to be a groove 45*a* which is opened in the right-angled portions 45*e* and 45*f*.

As illustrated in FIG. 3, a guide member 55 is provided on the discharge side of the feeding unit 30 such that the recording-finished medium R4 is not inserted into the feeding unit 30. As in the serviceable state S1 in FIG. 1, a leading edge regulating portion 55*a* (which regulates a movement of the leading edge R5 of the recording-finished medium R4 which is guided to the housing 10 side along the slope 61*a*) is formed on the lower side of the guide member 55. In addition, a hook portion 55*b* (which is a hook provided at a terminal-end portion 65 of the sheet member 60 and fastens a strap 65*a*) is formed in a portion on the upper side of the leading edge regulating portion 55*a* in the guide member 55.

As illustrated in FIG. 5 or the like, the frame-like front-end holding section 72 that configures the stacker (medium receiving unit) 50 has a base portion 52 of which the longitudinal direction is in the width direction D7, side portions 72*a* and 72*a* disposed on the opposite side sections in the width direction D7, a cross-linkage portion 72*c* that connects ends of the side portions 72*a* and 72*a* on a side opposite to the base portion 52. The base portion 52 has a cross-linkage portion 52*a* of which the longitudinal direction is in the width direction D7 and sliders 53 and 53 provided at opposite ends of the cross-linkage portion 52*a*. A hook portion 52*b* is provided in the cross-linkage portion 52*a* so as to fasten the strap (linkage section) 74 provided at the lowermost portion 67 of the sheet member 60. The cross-linkage portions 52*a* and 72*c* is bar-shaped or cylindrical portions of which the longitudinal direction is in the width direction D7. The side portion 72*a* is bar-shaped or cylindrical portions of which the longitudinal direction is in a direction substantially orthogonal to the width direction D7 and, as illustrated in FIG. 7, passes through an insertion portion 75*a* of the tilting mechanism 75 and is rotatable with the rotating axis 54 passing the sliders 53 and 53.

The slider 53 is rotatably inserted into the groove 45*a* of the rail 45, is guided into the groove 45*a*, and slides in the separating direction D2 and in the approaching direction D3. Thus, the base portion 52 of the front-end holding section 72 is slidably attached with respect to the rail 45 and is slidably provided with respect to the leg 40. The rotating axis 54 passing the sliders 53 and 53 becomes a central axis of the rotation of the stacker 50. In the tilting mechanism 75, as the front-end portion 66 of the sheet member 60 becomes closer to the terminal-end portion 65 of the sheet member 60, the angle θ becomes smaller with the base portion 52 as the center.

As illustrated in FIG. 7, latching portions 72*d* and 72*e* which are caused to engage with an engagement portion 75*e* of the tilting mechanism 75 are provided in the side portion 72*a*. FIG. 3 is a view illustrating a state of the stacker 50 when the latching portion 72*d* on the discharge side engages with the tilting mechanism 75. When the latching portion 72*e* on the housing 10 engages with the engagement portion 75*e*, an angle formed between the extending direction D10 of the front-end holding section 72 and the sliding direction D1 becomes greater than the angle θ illustrated in FIG. 3. In the cases, when the base portion 52 is positioned at the serviceable position L2 as illustrated in FIG. 3, the side portion 72*a* is held by the tilting mechanism 75 in a state of rising toward the discharge side from the base portion 52. Meanwhile, when the base portion 52 is placed at the accommodation position L1 as illustrated in FIG. 4, the side portion 72*a* is held by the tilting mechanism 75 in a state of being approximately parallel to the sliding direction D1.

The cross-linkage portion 72*c* on the discharge side passes through an insertion portion 66*a* formed at the front-end portion 66 of the sheet member 60. Accordingly, the front-end portion 66 of the sheet member is held in the front-end holding section 72 and the front-end portion 66 is positioned to be higher than the second connection portion 63 when the base portion 52 is placed at the serviceable position L2.

As illustrated in FIG. 7, in the tilting mechanism 75, an outer member 75*b* and the inner member 75*c* are coupled with each other and an insertion portion 75*a* passing the side portion 72*a* is formed so as to allow rotation in a perpendicular surface in the sliding direction D1. The presence of the tilting mechanism 75 causes the angle θ formed between the extending direction D10 of the front-end holding section 72 and the sliding direction D1 of the base portion 52 to be changed. The angle θ formed when the base portion 52 is placed at the accommodation position L1 as illustrated in FIG. 4, is smaller than the angle θ formed when the base portion 52 is placed at the serviceable position L2 as illustrated in FIG. 3. The engagement portion 75*e* (that engages with the latching portions 72*d* and 72*e* of the side portion 72*a*) is provided at an end on the discharge side of the tilting mechanism 75. A hook portion 75*d* (that is a hook provided at opposite edges of the second connection portion 63 of the sheet member 60 and fastens a strap 63*a*) is provided on the top surface of the inner member 75*c*.

The sheet member 60 is a main member that configures a basket for stacking the recording medium and is formed of a flexible sheet-shaped member such as clothes or vinyl. The flexible sheet member 60 has the front-end portion 66 on the discharge side of the recording-finished medium R4 from the terminal-end portion 65. As illustrated in FIG. 5, the cross-linkage portion 72*c* of the front-end holding section 72 passes through the insertion portion 66*a* of the front-end portion 66 of the sheet member 60. In addition, straps 63*a*, 65*a*, and 74 (which are hooked) are provided in the sheet member 60. Here, flexible straps 63*a* and 63*a* are provided on opposite edges of the second connection portion 63 of the sheet member 60 such that the second connection portion 63 is stretched outward in the width direction D7. The multiple straps 65*a* are provided on the terminal-end portion 65 of the sheet member 60 such that the terminal-end portion 65 is not coupled and does not move with the leading edge regulating portion 55*a* of the guide member. The multiple straps 74 (which draw the connection portion 64 to the housing 10 side at the time of accommodation of the stacker) are provided at the connection portion 64 between the front-end portion 66 and the terminal-end portion 65 in the sheet member 60. The connection portion 64 illustrated in FIG. 5 or the like is provided on the lowermost portion 67 of the curved surface 62*a*, but the connection portion 64 in which the strap (linkage section) 74 is provided may be positioned to be shifted from the lowermost portion 67.

As illustrated in FIG. 1, when a strap 65*a* provided on the terminal-end portion 65 is hooked by the hook portion 55*b* of the guide member 55, the strap 63*a* provided on the second connection portion 63 is hooked by the hook portion 75*d* of the tilting mechanism 75, and the front-end holding section 72 is drawn out such that the base portion 52 is placed at the serviceable position L2, a part of the flexible sheet member 60 forms an "arc shape" with a line connecting the straps 63*a* and 63*a* as a vertex, and the slope 61*a* and the curved surface 62*a* are formed before and after the second connection portion 63. The "arc shape" prevents buckling of the recording-finished medium and the properties of stacking and an amount of the stacking of the recording-finished medium are improved. Here, the hook portion 55*b* and the strap 65*a* configure the terminal-end holding section 71 and the hook portion 75*d* and the strap 63*a* configure the second connection-portion holding section 73.

The slope 61*a* descends to the terminal-end portion 65 from the second connection portion 63 (which is a connection portion) to the curved surface 62*a* and curved to form a downward convex shape when viewed from the side view. Here, a curve of the slope 61*a* forms the downward convex shape, which means that, as in side views illustrated in FIGS. 9A and 9B, the slope 61*a* is placed on the lower side from a line LINE 2 that connects the second connection portion 63 and the terminal-end portion 65.

The curved surface 62*a* has the front-end portion 66 which is higher than the second connection portion 63 that is a connection portion to the slope 61*a* and a curve between the front-end portion 66 and the second connection portion 63 forms a downward convex shape. The curved surface 62*a* illustrated in FIG. 1 has the lowermost portion 67 that is lower than the second connection portion 63 between the front-end portion 66 and the second connection portion 63. Here, a curve of the curved surface 62*a* forms the downward convex shape, which means that, as in side views illustrated in FIGS. 9A and 9B, the curved surface 62*a* is placed on the lower side from the line LINE 1 that connects the second connection portion 63 and the front-end portion 66.

The second connection portion 63 is bent to form an upward convex portion when viewed from the side. Here, the second connection portion 63 forms the upward convex shape, which means that, as in side views illustrated in FIGS. 9C and 9D, an angle θu on the upper side which is formed between the slope 61*a* and the curved surface 62*a* in the vicinity of the second connection portion 63 is greater than an angle θd on the lower side which is formed between the slope portion 61 and the curved portion 62. The second connection portion 63 illustrated in FIG. 1 is positioned on the housing 10 side from the discharge unit 17.

An operation of stacking the recording-finished medium R4 to the stacker 50 is described with reference to FIGS. 1 to 8.

When the recording-finished medium R4 is discharged from the discharge unit 17, the recording-finished medium R4 drops downward by the self-weight thereof as illustrated in FIG. 3. Here, since the recording medium R3 is supported by the unwinding mechanisms 21 and 31 such that the recording-finished medium R4 bends to the housing 10 side, the recording-finished medium R4 that drops downward from the discharge unit 17 as illustrated in FIG. 3 bends to the housing 10 side. Accordingly, although the second connection portion 63 is positioned on the housing 10 side from the discharge unit 17, the leading edge R5 of the recording-finished medium R4 comes into contact with the slope 61*a*. Thus, according to the disclosure, it is possible to expand the curved surface 62*a* and to increase the amount of stacking of the recording-finished medium R4.

Since the slope 61*a* descends to the terminal-end portion 65 from the second connection portion 63, the leading edge R5 of the recording-finished medium which is brought into contact with the slope 61*a* is guided to a side of the terminal-end portion 65 along the slope 61*a*. Particularly, since the slope 61*a* is curved to form the downward convex shape, the leading edge R5 of the recording-finished medium which is brought into contact with the vicinity of the second connection portion 63 which is steeper than the vicinity of the terminal-end portion 65 is likely to be guided to a side of the terminal-end portion 65. Thus, it is difficult for buckling or the like of the recording-finished medium to occur and for the leading edge of the recording-finished medium to be brought into bump contact with the sheet member, and the recording-finished medium is prevented from being in a disordered state and decrease of the amount of the stacking is suppressed. The guide of the leading edge R5 is regulated by the leading edge regulating portion 55*a*.

When the cutter 18 cuts the recording-finished medium R4 at the following edge R6, the recording-finished medium R4 is released from a nip between the transport roller pair (15 and 16) and is mounted on the sheet member 60 toward the front-end portion 66 from the terminal-end portion 65. Here, since the curved surface 62*a* is curved to form a downward convex shape, it is possible to stack more recording-finished media R4 on the sheet member 60. Particularly, the lowermost portion 67 lower than the second connection portion 63 is included in the curved surface 62*a*, and thereby it is possible to stack many recording-finished medium R4. In addition, since the recording-finished medium R4 is stacked over the second connection portion 63 which is bent so as to form an upward convex section, the recording-finished medium R4 is prevented from being rounded by the likeliness of winding and the decrease of the stacking amount is prevented. Particularly, the lowermost portion 67 lower than the second connection portion 63 is included in the curved surface 62*a* and thereby, the recording-finished medium R4 is effectively prevented from being rounded.

Further, as shown in FIG. 8, since the front-end portion 66 of the curved surface 62*a* is positioned higher than the second connection portion 63, the following edge R6 that sticks out from the curved surface 62*a* is unlikely to come into contact with a bed even in a case of the lengthy recording-finished medium R4 as illustrated in FIG. 8 and the recording-finished media R4 which are stacked over the second connection portion 63 which is bent to form the upward convex portion is unlikely to be collapsed.

As above, the recording apparatus 1 can more appropriately stack the recording-finished medium R4.

Next, an operation, an action, and an effect when the stacker 50 is accommodated are described.

In the serviceable state S1 illustrated in FIGS. 1 and 3, when the latching portion 72*d* (or latching portion 72*e*) is unlatched from the engagement portion 75*e* (refer to FIG. 7) of the tilting mechanism 75, it is possible to press the frame-like front-end holding section 72 and to move to the housing 10 side. Accordingly, the base portion 52 of the front-end holding section slides to the side of the accommodation position L1 from the serviceable position L2 as illustrated in the intermediate state S2 illustrated in FIG. 1, the front-end holding section 72 rotates about the rotating axis 54 in the sliding direction D1 and moves to the accommodation position L1. Therefore, the front-end portion 66 of the sheet member becomes closer to the terminal-end portion 65 of the sheet member and the angle θ between the extending direction D10 of the front-end holding section 72 and the sliding direction D1 of the base portion 52 becomes smaller. Meanwhile, a positional relationship between the second connection-portion holding section 73 and the terminal-end holding section 71 is maintained and as a result, the positional relationship between the second connection portion 63 and the terminal-end portion 65 in the sheet member 60 is actually maintained.

At this time, the connection portion 64 in the sheet member 60 which is linked to the base portion 52 by the strap 74 is coupled with the frame-like front-end holding section 72 and moves to the housing 10 side. Accordingly, the curved portion 62 is gradually folded to extend underneath the slope portion 61 with the connection portion 64 and the second connection portion 63 as a starting point. In the accommodated state S3, the angle θ formed between the extending direction D10 of the front-end holding section 72 and the sliding direction D1 of the base portion 52 becomes smaller in a range in which the front-end portion 66 is higher than the terminal-end portion 65 in the sheet member 60 and the front-end holding section 72 is accommodated below the housing 10. The positional relationship between the second connection-portion holding section 73 and the terminal-end holding section 71 is maintained and as a result, the positional relationship between the second connection portion 63 and the terminal-end portion 65 in the sheet member 60 is actually maintained. A curved portion 62 in the sheet member 60 is accommodated below the housing 10, in a state of being drawn into and folded the accommodation position L1 with the connection portion 64 as a starting point. In this way, the remaining portion (curved portion 62) of the sheet member 60 is prevented from sticking out from the accommodation position. Thus, the recording apparatus 1 decreases time and effort to press and accommodate the remaining portion of the flexible sheet member 60 by hand, and it is possible to easily accommodate the sheet member 60 and to accommodate so as to be compact when the stacker 50 is not used.

In addition, the front-end holding section 72 is drawn to the discharge side in the accommodated state S3 as shown in FIGS. 1 and 4, thereby, the base portion 52 of the front-end holding section slides to the side of the serviceable position L2 from the accommodation position L1 and the front-end holding section 72 rotates to an orientation which is shifted from the sliding direction D1 about the rotating axis 54 and moves to the side of the serviceable position L2. Therefore, the front-end portion 66 of the sheet member is separated from the terminal-end portion 65 of the sheet member and the angle θ formed between the extending direction D10 of the front-end holding section 72, and the sliding direction D1 of the base portion 52 becomes greater. The positional relationship between the second connection-portion holding section 73 and the terminal-end holding section 71 is maintained and as a result, the positional relationship between the second connection portion 63 and the terminal-end portion 65 in the sheet member 60 is actually maintained.

At this time, since the strap 74 fastened to the base portion 52 is slack, the connection portion 64 of the sheet member is stretched by the front-end portion 66 and moves to the discharge side. Accordingly, the folded sheet member 60 is unfolded. In the serviceable state S1, the angle θ formed between the extending direction D10 of the front-end holding section 72 and the sliding direction D1 of the base portion 52 becomes greater and the latching portion 72*d* (or latching portion 72*e*) engages with the engagement portion 75*e* of the tilting mechanism 75. Accordingly, the slope 61*a* and the curved surface 62*a* are formed in the flexible sheet member 60. Thus, in the recording apparatus 1, the stacker 50 is easily prepared.

(3) Modification Example

Various modification examples are considered according to the invention.

For example, the recording apparatus may be an apparatus which performs recording on one recording medium other than the apparatus that switches multiple recording mediums and performs recording.

The terminal-end holding section that holds the terminal-end portion of the sheet section may be a bar-shaped or cylindrical lengthy member passing through the insertion portion formed on the terminal-end portion of the sheet section other than a combination of the hook portion 55*b* and the strap 65*a* described above. The lengthy member may be provided in the guide member 55, the leg 40, the housing 10, or the like.

The front-end holding section that holds the front-end portion of the sheet section may be formed by a combination of the strap and the hook member provided at the front-end portion of the sheet section other than the front-end holding section 72 that has the cross-linkage portion 72*c* described above. The hook member may be provided in the guide member 55, the leg 40, the housing 10, or the like.

The second connection portion holding section that holds the second connection portion may be a bar-shaped or cylindrical lengthy member passing through the insertion portion formed on the connection portion other than a combination of the hook portion 75*d* and the strap 63*a* described above. The lengthy member may be provided in the tilting mechanism 75, the guide member 55, the leg 40, the housing 10, or the like.

Even in a case where the second connection portion 63 of the slope and the curved surface is placed immediately under the discharge unit 17 (a position overlapped with the perpendicular surface V1) or in a case where the second connection portion 63 is on the discharge side from immediately below the discharge unit 17, the effects that the recording-finished media can be more appropriately stacked is achieved. According to a modification example in which the second connection portion 63 is disposed on the discharge side immediately below the discharge unit 17, it is possible to more appropriately stack the recording-finished medium R4.

When the base portion 52 slides in the sliding direction D1 and the positional relationship between the second connection-portion holding section 73 and the terminal-end holding section 71 is maintained, the positional relationship is preferable in that the medium receiving section may be easily detached and attached. However, even when the positional relationship is not maintained such as the second connection-portion holding section 73 and the terminal-end holding section 71 becomes closer, the effects of easily accommodating the flexible sheet section are obtained.

It is preferable that the recording media can be more appropriately stacked when the second connection portion 63 is present. However, the effects of easily accommodating the flexible sheet section without the second connection portion may be achieved.

Even when the terminal-end portion 65 moves in a range in which the front-end portion 66 of the sheet section becomes closer to the terminal-end portion 65 of the sheet section when the base portion 52 slides to a side of the accommodation position L1 from the serviceable position L2, the effects of easily accommodating the sheet section are achieved.

It is preferable that, when the tilting mechanism is present, the orientation of the front-end holding section can change between the accommodation position and the serviceable position. However the effects of easily accommodating the sheet section are achieved even without the tilting mechanism.

Further, when the rail described above is provided in the leg below the housing, it is preferable that the space below the housing can be used as a stacking space of the recording-finished medium. However, even when the rail is provided in the housing, the effects of easily accommodating the sheet section are achieved. Means in which the base portion of the front-end holding section of the medium receiving section can slide may include various means such as a structure in which a bar-shaped member is inserted into the lengthy cylindrical member, other than the rail.

Figure 10:
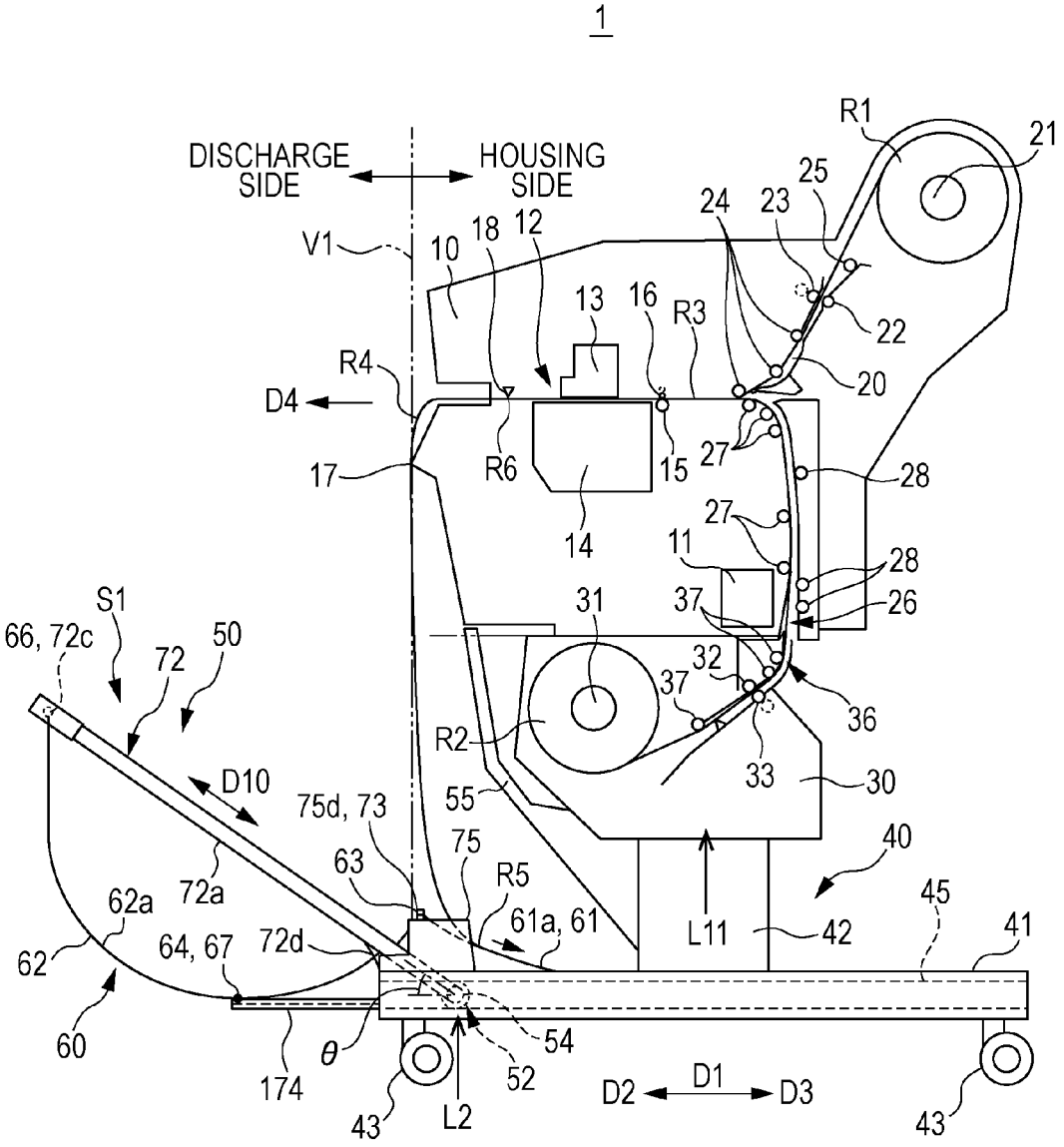
FIG. 10 is a vertical cross-sectional view illustrating the inside of a recording apparatus according to a modification example.
Figure 11:
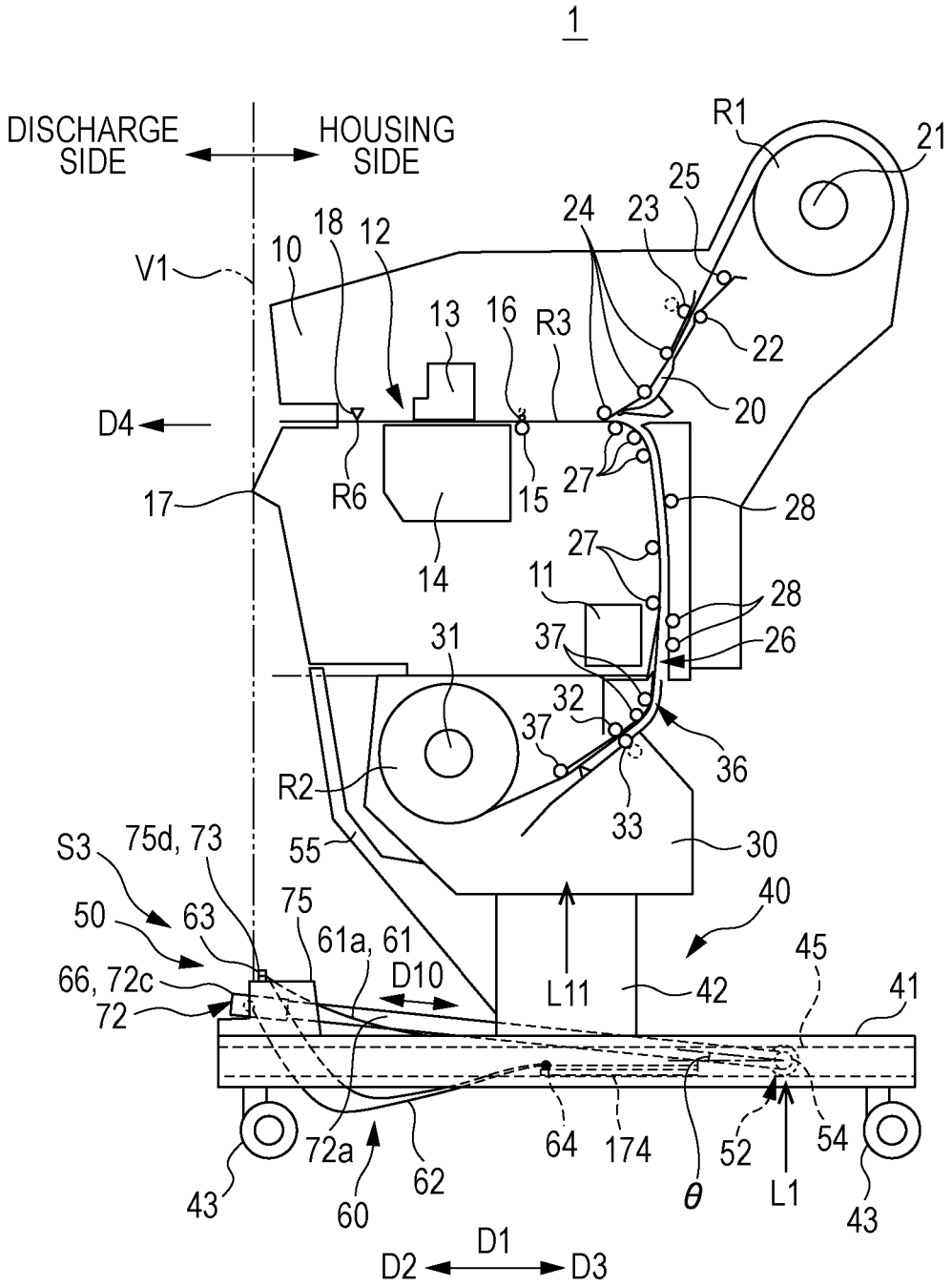
FIG. 11 is a vertical cross-sectional view illustrating the recording apparatus according to the modification example in a state in which a stacker is accommodated.

FIGS. 10 and 11 illustrate the modification example in which a hard extension member 174 is used as the linkage section. The extension member 174 has the longitudinal direction in the sliding direction D1 and slides along the rail 45 and links the connection portion 64 of the sheet member 60 to the base portion 52 of the front-end holding section 72.

In the serviceable state S1 illustrated in FIG. 10, the frame-like front-end holding section 72 is moved to the housing 10 side, thereby, the base portion 52 slides to the side of the accommodation position L1 and from the serviceable position L2, the front-end holding section 72 rotates in an orientation in the sliding direction D1, and the front-end portion 66 of the sheet member becomes closer to the terminal-end portion 65 of the sheet member. In addition, the connection portion 64 linked to the base portion 52 by the extension member 174 in the sheet member 60 moves to the housing 10 side. Accordingly, the remaining portion (curved portion 62) of the sheet member 60 is prevented from sticking out from the accommodation position and it is possible to easily accommodate the sheet member 60.

Meanwhile, in the accommodated state S3 illustrated in FIG. 11, the front-end holding section 72 is drawn to the discharge side, thereby, the base portion 52 slides to the side of the serviceable position L2 from the accommodation position L1, the front-end holding section 72 rotates in an orientation shifted from the sliding direction D1, and the front-end portion 66 of the sheet member is separated from the terminal-end portion 65 of the sheet member. In addition, the connection portion 64 linked to the base portion 52 by the extension member 174 in the sheet member 60 moves to the discharge side. Accordingly, the folded sheet member 60 is unfolded and the slope 61*a* and the curved surface 62*a* are formed in the sheet member 60.

(4) Conclusion

As described above, according to various aspects of the invention, it is possible to provide a technology or the like in which it is possible to easily accommodate the flexible sheet member. Needless to say, the technology or the like that includes only the configurational requirements according to the independent claims without including the configurational requirements according to the dependent claims achieves the basic action and effects described above.

In addition, a configuration in which configurations disclosed in the embodiments and the modification examples described above are replaced with each other or the combination thereof is modified, a configuration in which known technologies and configurations disclosed in the embodiments and the modification examples described above are replaced with each other or the combination thereof is modified, or the like can be embodied. The invention includes these configurations or the like.

What is claimed is:

1. A recording apparatus comprising:

a recording unit that performs recording on a recording medium;

a discharge unit that discharges the recording medium on which recording is finished; and a medium receiving unit that receives the discharged recording medium, wherein the medium receiving unit includes a sheet section which is flexible and of which a front-end portion is disposed to be closer to a discharge side of the recording medium than a terminal-end portion, and wherein, when the medium receiving unit is transited from a serviceable state to an accommodated state, the front-end portion of the sheet section becomes closer to the terminal-end portion of the sheet section and a connection portion between the front-end portion and the terminal-end portion of the sheet section moves to a side opposite to the discharge side.

2. The recording apparatus according to claim 1, wherein, when the medium receiving unit is transited from the serviceable state to the accommodated state, a positional relationship between a second connection portion between the connection portion and the terminal-end portion of the sheet section and the terminal-end portion is maintained.

3. A recording apparatus comprising:

a recording unit that performs recording on a recording medium;

a discharge unit that discharges the recording medium on which recording is finished; and a medium receiving unit that receives the discharged recording medium, wherein the medium receiving unit includes a sheet section which is flexible and of which a front-end portion is disposed to be closer a discharge side of the recording medium than a terminal-end portion, a front-end holding section that has a base portion which is slidable in a sliding direction passing through an accommodation position and a serviceable position, extends from the base portion to a discharge side, and holds the front-end portion of the sheet section, and a linkage section that links a connection portion between the front-end portion and the terminal-end portion to the base portion in the sheet section, and wherein, when the base portion of the front-end holding section slides to the side of the accommodation position from the serviceable position, the front-end portion of the sheet section becomes closer to the terminal-end portion of the sheet section and the connection portion of the sheet section moves to a side opposite to the discharge side.

4. The recording apparatus according to claim 3, wherein the medium receiving unit includes a terminal-end holding section that holds the terminal-end portion of the sheet section, and a second connection portion holding section that holds a second connection portion between the connection portion and the terminal-end portion in the sheet section, and wherein, when the base portion of the front-end holding section slides to the side of the accommodation position from the serviceable position, a positional relationship between a second connection portion holding section and the terminal-end holding section is maintained.

5. The recording apparatus according to claim 4, wherein the sheet section has a slope with which a leading edge of the recording medium that is discharged and drops from the discharge unit comes into contact between the second connection portion and the terminal-end portion, and wherein the slope descends from the second connection portion to the terminal-end portion.

6. The recording apparatus according to claim 3, wherein the medium receiving unit includes a tilting mechanism in which an angle θ between an extending direction and the sliding direction of the front-end holding section is changed, and wherein the angle θ formed when the base portion of the front-end holding section is disposed at the accommodation position is smaller than the angle θ formed when the base portion of the front-end holding section is disposed at the serviceable position.

7. The recording apparatus according to claim 6, further comprising:

a rail that is provided in the sliding direction, wherein the base portion of the front-end holding section is mounted so as to be slidable along the rail, and wherein, in the tilting mechanism, as the front-end portion of the sheet section becomes closer to the terminal-end portion of the sheet section, the angle θ becomes smaller with the base portion as the center.

8. The recording apparatus according to claim 3, further comprising:

a housing in which the discharge unit is provided; and a leg that supports the housing, wherein the base portion of the front-end holding section is provided to be slidable with respect to the leg.

* * * * *